US008427410B2

(12) United States Patent
Huang et al.

(10) Patent No.: US 8,427,410 B2
(45) Date of Patent: Apr. 23, 2013

(54) DRIVING METHOD AND DISPLAY DEVICE UTILIZING THE SAME

(75) Inventors: Chiao-Nan Huang, Xizhou Township (TW); Tai-Ann Chen, Xindian (TW); Heng-Yin Chen, Tuku Town (TW); An-Cheng Chen, Hsinchu (TW)

(73) Assignee: Industrial Technology Research Institute, Chutung (TW)

( * ) Notice: Subject to any disclaimer, the term of this patent is extended or adjusted under 35 U.S.C. 154(b) by 615 days.

(21) Appl. No.: 12/690,103

(22) Filed: Jan. 19, 2010

(65) Prior Publication Data

US 2010/0295875 A1 Nov. 25, 2010

(30) Foreign Application Priority Data

May 19, 2009 (TW) ..... 98116516 A

(51) Int. Cl.
*G09G 3/36* (2006.01)

(52) U.S. Cl.
USPC ..... 345/88; 345/690

(58) Field of Classification Search ..... 345/87–89, 345/95, 690, 694
See application file for complete search history.

(56) References Cited

U.S. PATENT DOCUMENTS

| | | | |
|---|---|---|---|
| 6,268,839 | B1 | 7/2001 | Yang |
| 6,982,691 | B2 | 1/2006 | Lee |
| 7,034,798 | B2 | 4/2006 | Masazumi |
| 2005/0253875 | A1 | 11/2005 | Johnson |
| 2006/0119782 | A1 | 6/2006 | Sha |
| 2008/0042959 | A1 | 2/2008 | Ben-Shalom |

*Primary Examiner* — Ricardo L Osorio
(74) *Attorney, Agent, or Firm* — Wang Law Firm, Inc.; Li K. Wang; Stephen Hsu

(57) ABSTRACT

A display device including a gate driver, a data driver and a plurality of sub-pixels is disclosed. The gate driver sequentially asserts a first scan signal and a second scan signal. The data driver provides a first data signal and a second data signal. When the first scan signal is asserted, the first scan signal and the first data signal respond with a first response signal. When the second scan signal is asserted, the second scan signal and the second data signal respond with a second response signal. The pulse of the first response signal is different from the pulse of the second response signal. A first sub-pixel among the sub-pixels displays a first color according to the first response signal. A second sub-pixel among the sub-pixels displays a second color according to the second response signal, and the first color is different from the second color.

36 Claims, 8 Drawing Sheets

DRIVING METHOD AND DISPLAY DEVICE UTILIZING THE SAME

CROSS REFERENCE TO RELATED APPLICATIONS

This Application claims priority of Taiwan Patent Application No. 098116516, filed on May 19, 2009, the entirety of which is incorporated by reference herein.

BACKGROUND

1. Technical Field

The disclosure relates to a display device and a driving method, and more particularly to a chromatic display device and a driving method thereof.

2. Description of the Related Art

Because cathode ray tubes (CRTs) are inexpensive and provide high definition, they are utilized extensively in televisions and computers. With technological development, new flat-panel displays are continually being developed. When a larger display panel is required, the weight of the flat-panel display does not substantially change when compared to CRT displays. Thus, flat-panel displays are widely used in the market.

SUMMARY

Display devices are provided. An exemplary embodiment of a display device comprises a gate driver, a data driver and a plurality of sub-pixels. The gate driver provides a first scan signal and a second scan signal and sequentially asserts the first and the second scan signals. The data driver provides a first data signal and a second data signal. When the first scan signal is asserted, the first scan signal and the first data signal respond with a first response signal. When the second scan signal is asserted, the second scan signal and the second data signal respond with a second response signal. The pulse of the first response signal is different from the pulse of the second response signal. A first sub-pixel among the sub-pixels displays a first color according to the first response signal. A second sub-pixel among the sub-pixels displays a second color according to the second response signal, and the first color is different from the second color.

Another exemplary embodiment of a display device comprises a gate driver, a data driver and a plurality of sub-pixels. The gate driver provides a scan signal. The data driver provides a first data signal and a second data signal. The scan signal and the first data signal respond with a first response signal. The scan signal and the second data signal respond with a second response signal. The pulse of the first response signal is different from the pulse of the second response signal. A first sub-pixel among the sub-pixels displays a first color according to the first response signal. A second sub-pixel among the sub-pixels displays a second color according to the second response signal. The first color is different from the second color.

Driving methods are provided. An exemplary embodiment of a driving method is described in the following. A first scan signal and a second scan signal are sequentially asserted. A first data signal is provided when the first scan signal is asserted. The first scan signal and the first data signal respond with a first response signal. A second data signal is provided when the second scan signal is asserted. The second scan signal and the second data signal respond with a second response signal. The pulse of the first response signal is different from the pulse of the second response signal. The first response signal is provided to a first sub-pixel among a plurality of sub-pixels. The first sub-pixel displays a first color. The second response signal is provided to a second sub-pixel among a plurality of sub-pixels. The second sub-pixel displays a second color. The first color is different from the second color.

Another exemplary embodiment of a driving method is described in the following. A scan signal is provided. A first response signal is responded according to the scan signal and a first data signal. A second response signal is responded according to the scan signal and a second data signal. The pulse of the first response signal is different from the pulse of the second response signal. The first response signal is provided to a first sub-pixel among a plurality of sub-pixels. The first sub-pixel displays a first color. The second response signal is provided to a second sub-pixel among a plurality of sub-pixels. The second sub-pixel displays a second color and the first color is different from the second color.

A detailed description is given in the following embodiments with reference to the accompanying drawings.

BRIEF DESCRIPTION OF THE DRAWINGS

The disclosure can be more fully understood by referring to the following detailed description and examples with references made to the accompanying drawings, wherein.

DETAILED DESCRIPTION

The following description is of the contemplated mode of carrying out the disclosure. This description is made for the purpose of illustrating the general principles of the disclosure and should not be taken in a limiting sense. The scope of the disclosure is determined by reference to the appended claims.

Figure 1:
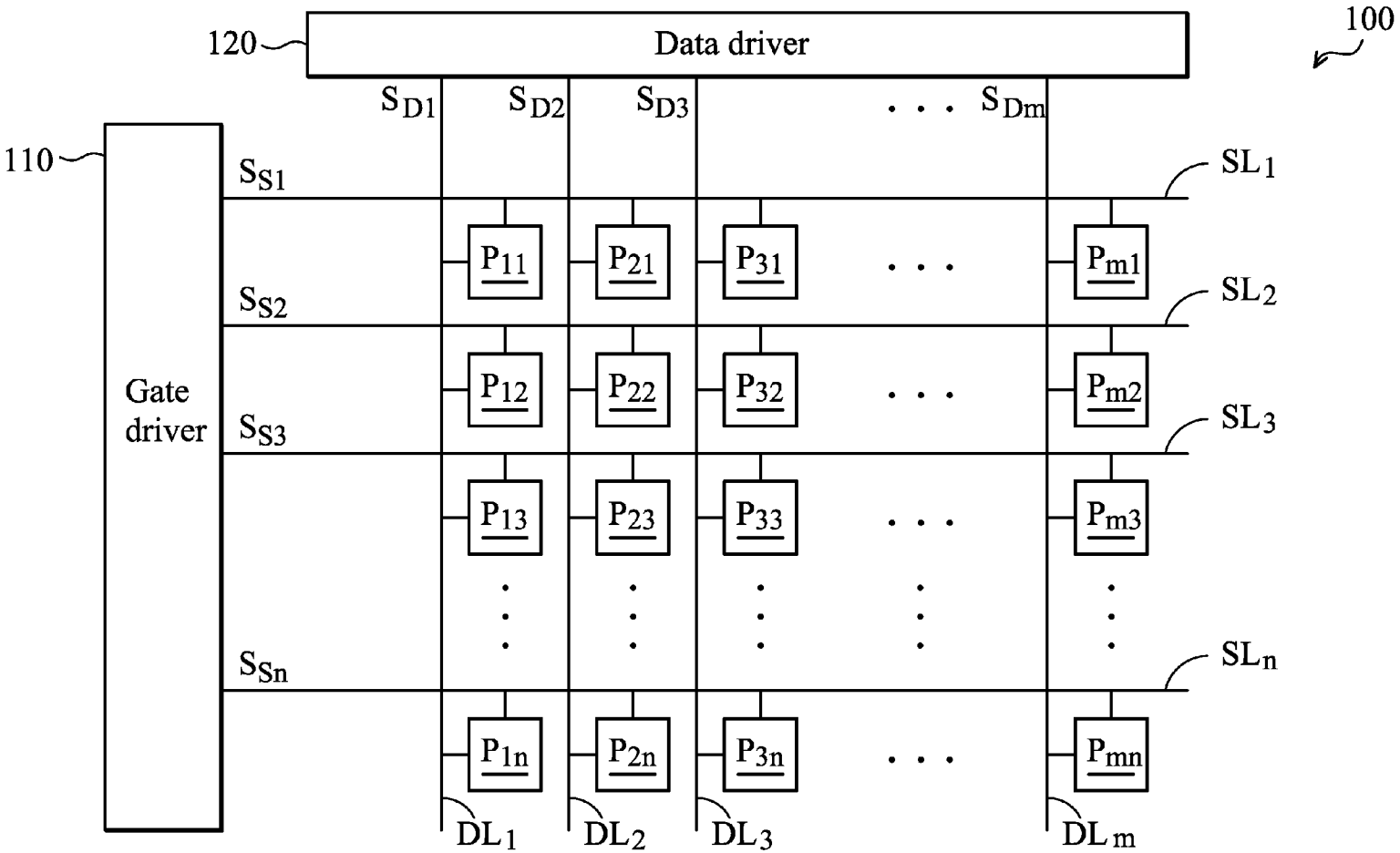
FIG. 1 is a schematic diagram of an exemplary embodiment of a display device.

FIG. 1 is a schematic diagram of an exemplary embodiment of a display device. The display device 100 comprises a gate driver 110, a data driver 120, and sub-pixels $P_{11}$~$P_{mn}$. The gate driver 110 provides scan signals $S_{S1}$~$S_{Sn}$ to scan lines $SL_1$~$SL_n$. In one embodiment, the gate driver 110 simultaneously outputs the scan signals $S_{S1}$~$S_{Sn}$ and only asserts one of the scan signals $S_{S1}$~$S_{Sn}$. In other embodiments, the gate driver 110 utilizes a dynamic driving scheme (DDS) to provide the scan signals $S_{S1}$ ~$S_{Sn}$ to the scan lines $SL_1$~$SL_n$.

Figure 2:
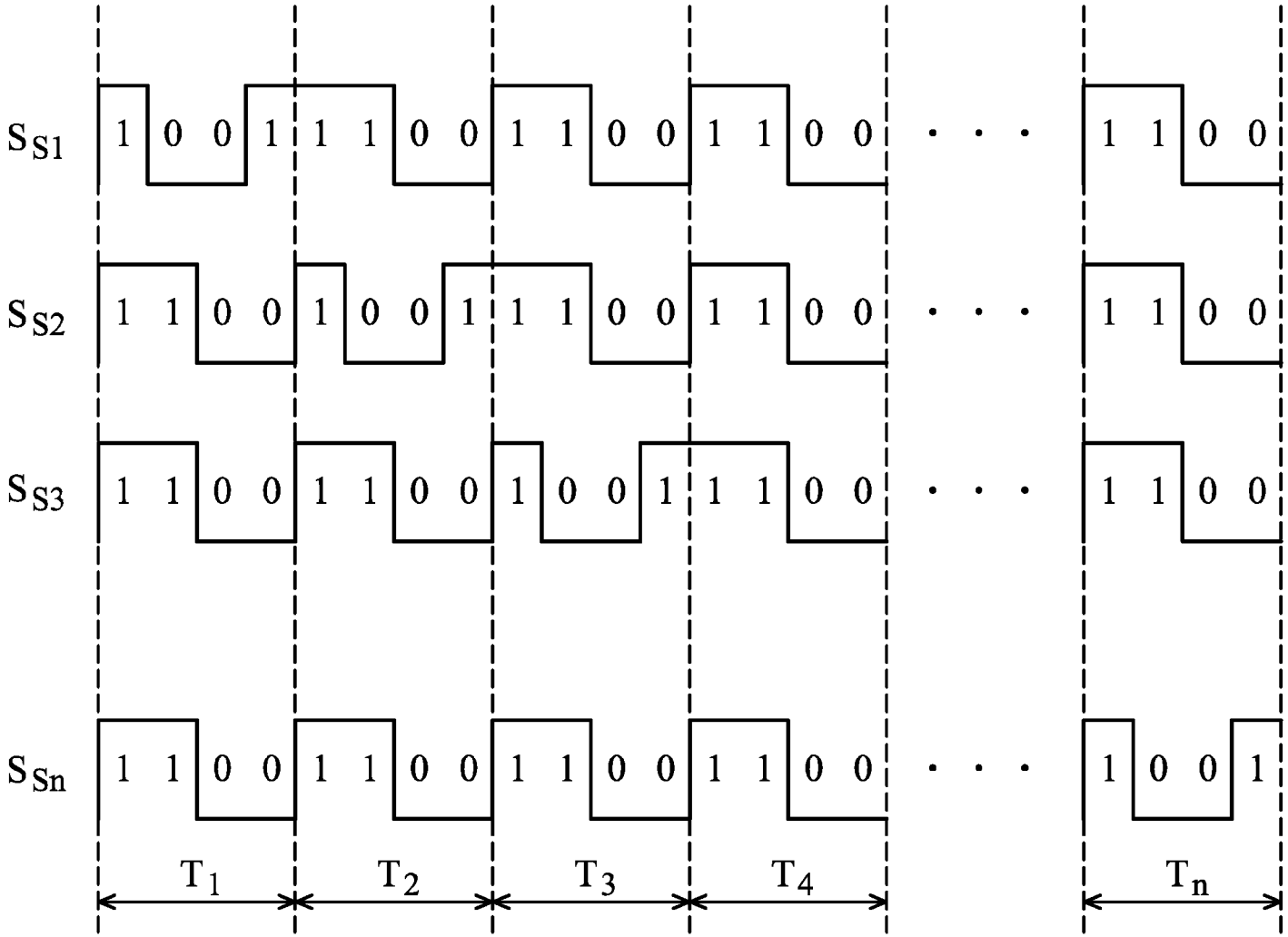
FIG. 2 is a schematic diagram of an exemplary embodiment of the scan signals.

FIG. 2 is a schematic diagram of an exemplary embodiment of the scan signals $S_{S1}$~$S_{Sn}$. In this embodiment, the gate driver 110 simultaneously outputs the scan signals $S_{S1}$~$S_{Sn}$. In the same period, only one scan signal is asserted and other scan signals are unasserted. For example, the scan signal $S_{S1}$ is in an asserted state and the scan signal $S_{S2}$~$S_{Sn}$ are in an unasserted state in period $T_1$. In period $T_2$, the scan signal $S_{S2}$ is in an asserted state and the scan signal $S_{S1}$, $S_{S3}$~$S_{Sn}$ are in an unasserted state.

In this embodiment, the digital code of the asserted scan signal is 1001 and the digital code of the unasserted scan signal is 1100, but the disclosure is not limited thereto. In some embodiments, other digital codes can replace the digital codes (e.g. 1001 and 1100) to indicate the asserted scan signal and the unasserted scan signal.

Referring to FIG. 1, the data driver 120 provides data signal $S_{D1}$~$S_{Dm}$ to the sub-pixels $P_{11}$~$P_{mn}$ via data lines $DL_1$~$DL_m$. In this embodiment, each of the data signal $S_{D1}$~$S_{Dm}$ and the asserted scan signal respond to a response signal. Thus, the amount of response signals is m. For example, when the scan signal $S_{S1}$ is asserted, the asserted scan signal $S_{S1}$ ane the data signal $S_{D1}$~$S_{Dm}$ respond with m response signals. Similarly, when the scan signal $S_{S2}$ is asserted, the asserted scan signal $S_{S2}$ and the data signal $S_{D1}$~$S_{Dm}$ respond with m response signals.

In this embodiment, the amount of pulses of the response signals relates to the color displayed by the corresponding sub-pixel. For example, the amount of pulses of the response signals received by the sub-pixels displaying the different colors may be different. Assuming the sub-pixel $P_{11}$ displays a red color, the sub-pixel $P_{12}$ displays a green color, and the sub-pixel $P_{13}$ displays a blue color, in one embodiment, the amount of pulses of the response signal received by the sub-pixel $P_{11}$ may be more than the amount of pulses of the response signal received by the sub-pixel $P_{12}$ and the amount of pulses of the response signal received by the sub-pixel $P_{13}$. The amount of pulses of the response signal received by the sub-pixel $P_{12}$ may be more than the amount of pulses of the response signal received by the sub-pixel $P_{13}$.

The sub-pixels display the corresponding colors according to the response signals. In this embodiment, the sub-pixels are arranged by an array. The amount of rows (horizontal direction) of the array is less than 500. In other words, the amount of scan lines is less than 500, but the disclosure is not limited thereto.

Figure 3A:
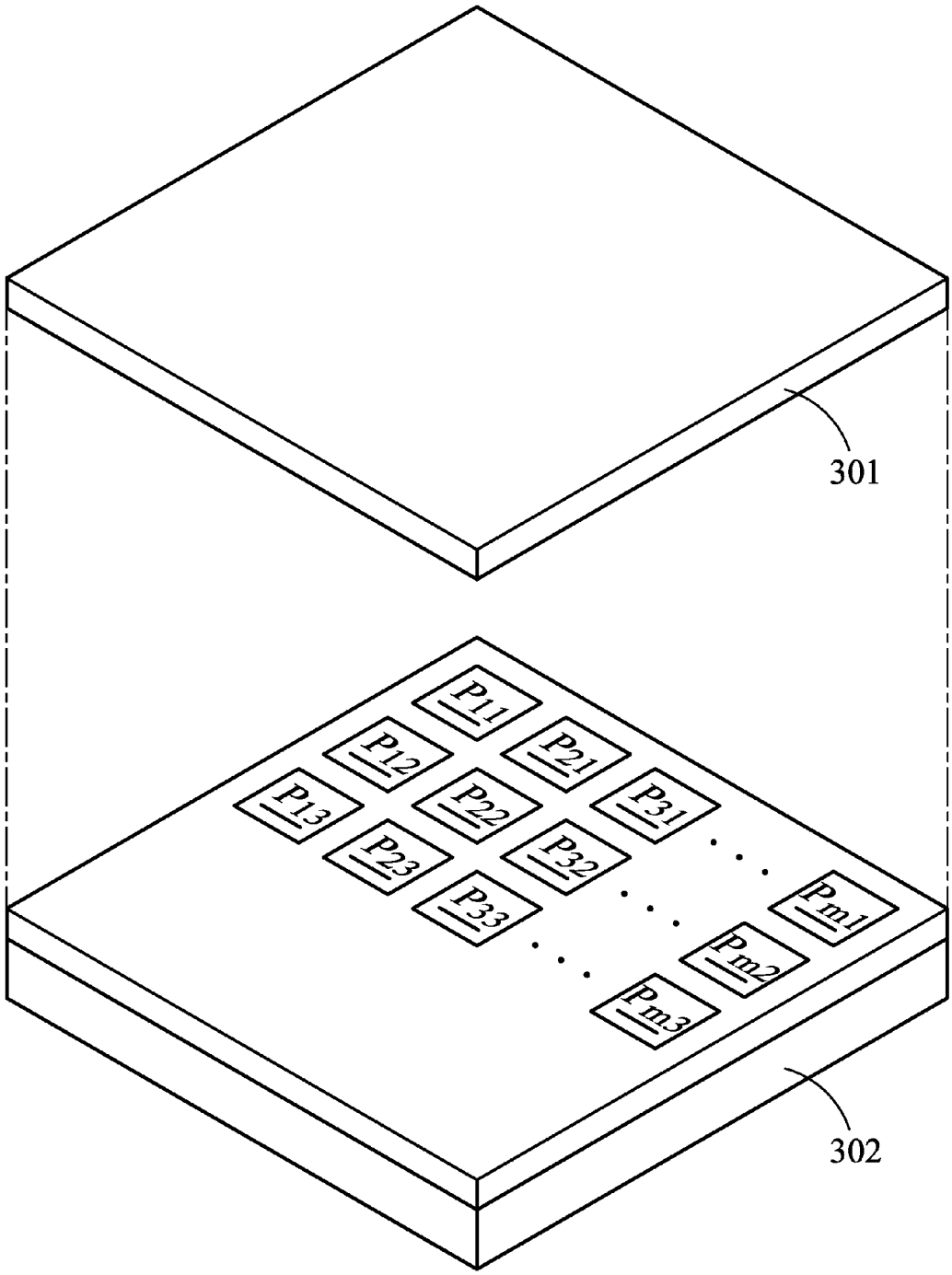
FIG. 3A is a schematic diagram of an exemplary embodiment of forming the sub-pixels.

Additionally, the disclosure does not limit the method of forming the sub-pixels $P_{11}$~$P_{mn}$. FIG. 3A is a schematic diagram of an exemplary embodiment of forming the sub-pixels $P_{11}$~$P_{mn}$. The sub-pixels $P_{11}$~$P_{mn}$ are formed between the electrode layers (e.g. ITO) 301 and 302. In this embodiment, the structure of the sub-pixels $P_{11}$~$P_{mn}$ is a single-layered structure. Thus, the sub-pixels $P_{11}$~$P_{mn}$ do not overlap with each other.

Figure 3B:
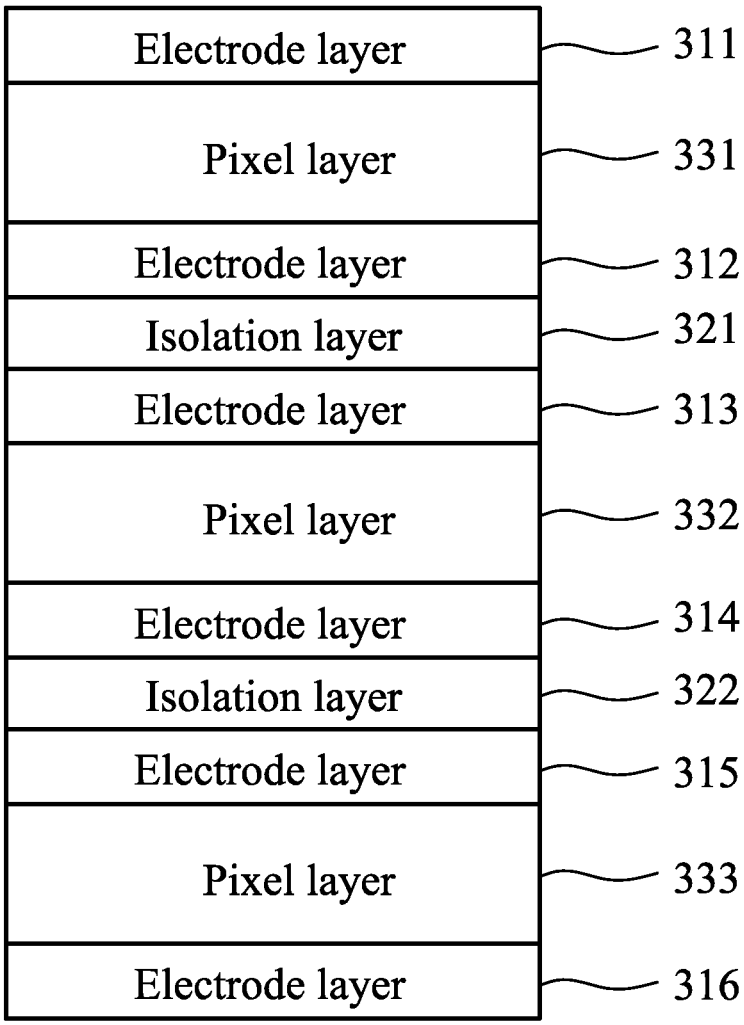
FIG. 3B is a schematic diagram of another exemplary embodiment of forming the sub-pixels.

FIG. 3B is a schematic diagram of another exemplary embodiment of forming the sub-pixels $P_{11}$~$P_{mn}$. The sub-pixel layer 331 is disposed between the electrode layers 311 and 312, wherein the sub-pixels of the sub-pixel layer 331 display the red color. The sub-pixel layer 332 is disposed between the electrode layers 313 and 314, wherein the sub-pixels of the sub-pixel layer 332 display the green color. The sub-pixel layer 333 is disposed between the electrode layers 315 and 316, wherein the sub-pixels of the sub-pixel layer 333 display the blue color. Furthermore, an isolation layer 321 is disposed between the electrode layers 312 and 313 and an isolation layer 322 is disposed between the electrode layers 314 and 315.

In the structure shown in FIG. 3B, the gate driver 110 can utilize the same or different scan lines to provide the scan signals to the pixel layers. For example, the gate driver 110 utilizes the different scan lines (e.g. $SL_1$~$SL_3$) to provide the different scan signals (e.g. $S_{S1}$~$S_{S3}$) to the pixel layers (e.g. layers 331~333 shown in FIG. 3B). In one embodiment, the layers 311, 313, and 315 receive the scan signals $S_{S1}$~$S_{S3}$ respectively. In this case, the electrode layers 312, 314, and 316 receive data signals. In another embodiment, the electrode layers 312, 314, and 316 receive the scan signals $S_{S1}$~$S_{S3}$ and the layers 311, 313, and 315 receive data signals.

In other embodiments, the gate driver 110 can utilize a single scan line to provide scan signal to the pixel layers. In this case, although each pixel layers (e.g. layers 331~333 shown in FIG. 3B) receive the same scan signal, the data signals provided to each pixel layers are used to control each pixel layers. For example, assuming the electrode layers 311, 313, and 315 receive a scan signal and the electrode layers 312, 314, and 316 receive the different data signals. When the data signals are controlled, each electrode layer can be respectively controlled. Additionally, in this embodiment, the sub-pixels coupled to the same scan line display the same color. For example, the sub-pixels $P_{11}$, $P_{21}$, $P_{31}$, . . . , $P_{m1}$ coupled to the scan line $SL_1$ display the red color. The sub-pixels $P_{12}$, $P_{22}$, $P_{32}$, . . . , $P_{m2}$ coupled to the scan line $SL_2$ display the green color. The sub-pixels $P_{13}$, $P_{23}$, $P_{33}$, . . . , $P_{m3}$ coupled to the scan line $SL_3$ display the blue color.

The disclosure does not limit the color displayed by the sub-pixel. In another embodiment, the sub-pixels coupled to the same data line display the same color. For example, the sub-pixels $P_{11}$, $P_{12}$, $P_{13}$, . . . , $P_{1n}$ coupled to the data line $DL_1$ display the red color. The sub-pixels $P_{21}$, $P_{22}$, $P_{23}$, . . . , $P_{2n}$ coupled to the data line $DL_2$ display the green color. The sub-pixels $P_{31}$, $P_{32}$, $P_{33}$, . . . , $P_{3n}$ coupled to the data line $DL_3$ display the blue color.

In this case, the scan signal $S_{S1}$ and the data signal $S_{D1}$ can respond with a first response signal. The scan signal $S_{S1}$ and the data signal $S_{D2}$ can respond with a second response signal. The scan signal $S_{S1}$ and the data signal $S_{D3}$ can respond with a third response signal. The sub-pixel $P_{11}$ can display the corresponding color (e.g. the red color) according to the first response signal. The sub-pixel $P_{21}$ can display the corresponding color (e.g. the green color) according to the second response signal. The sub-pixel $P_{31}$ can display the corresponding color (e.g. the blue color) according to the third response signal. In another embodiment, the sub-pixels $P_{11}$, $P_{21}$, and $P_{31}$ do not overlap with each other (as shown in FIG. 3A). In other embodiments, the sub-pixels $P_{11}$, $P_{21}$, and $P_{31}$ overlap with each other (as shown in FIG. 3B).

In one embodiment, each of the sub-pixels comprises Bistable material such as Cholesteric Liquid Crystal (ChLC). When each of the sub-pixels comprises the ChLC, each of the sub-pixels displays the corresponding color according to the voltage difference between the corresponding scan signal and the corresponding data signal. Thus, the response signal, which responded by the data signal and the scan signal, represents the voltage difference between the data signal and the scan signal.

Figure 4A:
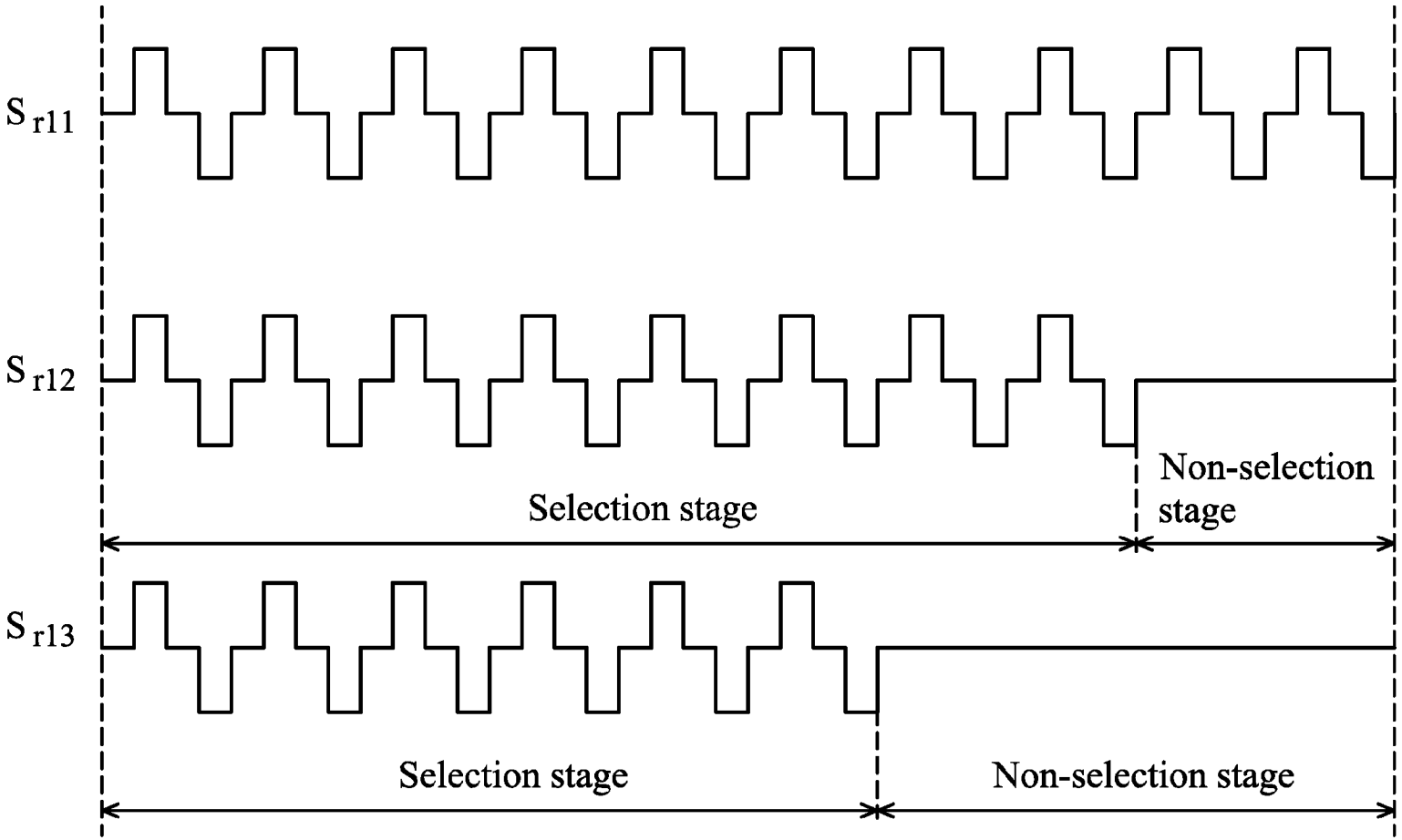
FIG. 4A is a schematic diagram of an exemplary embodiment of the response signals.

FIG. 4A is a schematic diagram of an exemplary embodiment of the response signals. The response signals shown in FIG. 4A can be generated according to the corresponding scan signal and the corresponding data signal. Assuming the sub-pixel $P_{11}$ displays the red color, the sub-pixel $P_{12}$ displays the green color, and the sub-pixel $P_{13}$ displays the blue color, the symbol $S_{r11}$ represents the response signal received by the sub-pixel $P_{11}$, the symbol $S_{r12}$ represents the response signal received by the sub-pixel $P_{12}$, and the symbol $S_{r13}$ represents the response signal received by the sub-pixel $P_{13}$. In this embodiment, when the amount of pulses of the response signal is increased, the brightness of the corresponding sub-pixel is brighter.

As shown in FIG. 4A, the response signal $S_{r12}$ comprises a selection stage and a non-selection stage and the response signal $S_{r13}$ also comprises a selection stage and a non-selection stage. The selection stage of the response signal $S_{r12}$ is longer than the selection stage of the response signal $S_{r13}$. The non-selection stage of the response signal $S_{r12}$ is shorter than the non-selection stage of the response signal $S_{r13}$. In this embodiment, the amount of pulses of the non-selection stage of the response signal $S_{r12}$ or $S_{r13}$ is equal to zero. In addition, the response signal $S_{r11}$ does not comprise a non-selection stage.

Figure 4B:
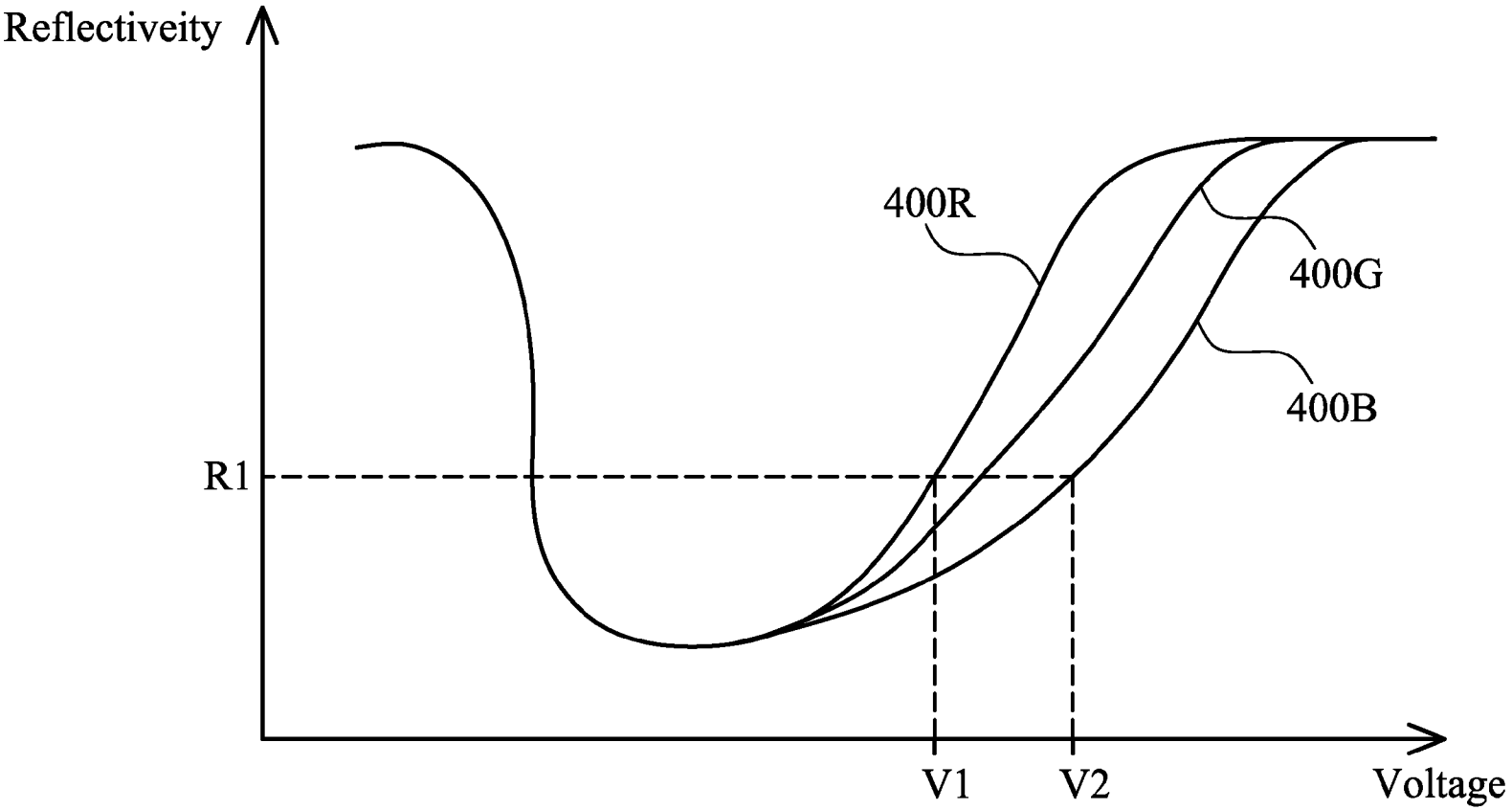
FIG. 4B shows the reflectivity-voltage curves of the sub-pixels.

Before providing the response signal to the sub-pixels $P_{11}$, $P_{12}$, and $P_{13}$, if the different preset voltages are provided to the sub-pixels $P_{11}$, $P_{12}$, and $P_{13}$, reflectivity-voltage curves can be defined according to the reflectivity of the sub-pixels $P_{11}$, $P_{12}$, and $P_{13}$. FIG. 4B shows the reflectivity-voltage curves of the sub-pixels $P_{11}$, $P_{12}$, and $P_{13}$. The curve 400R is the reflectivity-voltage curve of the sub-pixel $P_{11}$. The curve 400G is the reflectivity-voltage curve of the sub-pixel $P_{12}$. The curve 400B is the reflectivity-voltage curve of the sub-pixel $P_{13}$.

Since the curves 400R, 400G, and 400B are not completely overlapping, the amount of pulses of the response signals $S_{r11}$~$S_{r13}$ are different (as shown in FIG. 4A). In another embodiment, if the amount of pulses of the response signals $S_{r11}$ and $S_{r12}$ are the same, the curves 400R and 400G are completely overlapping.

When the corresponding scan signal and the corresponding data signal are suitably adjusted according to the curves 400R, 400G, and 400B, the appropriate response signals for the sub-pixels are generated. When the generated response signal are provided to the corresponding sub-pixels, new reflectivity-voltage curves of the sub-pixels will be generated and the new reflectivity-voltage curves are completely overlapping with each other. For example, if the curve 400R is required to completely overlap the curve 400G, the scan signal and the data signal received by the sub-pixel $P_{11}$ are adjusted to increase the amount of pulses of the response signal $S_{r11}$. If the curve 400B is required to completely overlap the curve 400G, the scan signal and the data signal received by the sub-pixel $P_{13}$ are adjusted to reduce the amount of pulses of the response signal $S_{r13}$.

Referring to FIG. 4B, if the voltage V1 is provided to the sub-pixel $P_{11}$, the reflectivity of the sub-pixel $P_{11}$ is R1. If the voltage V2 is provided to the sub-pixel $P_{13}$, the reflectivity of the sub-pixel $P_{13}$ is also equal to R1. In this embodiment, the voltage difference between the voltages V1 and V2 is less than 100V.

Figure 5:
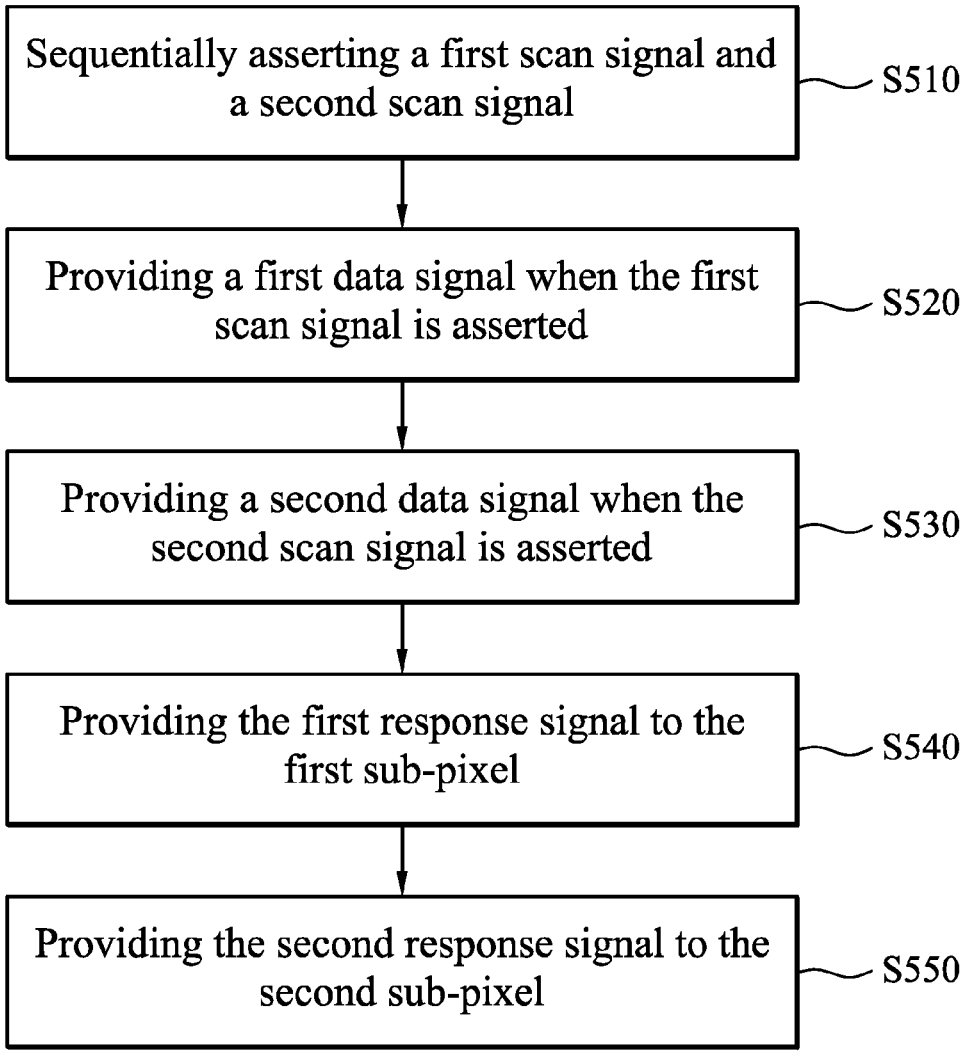
FIG. 5 is a schematic diagram of an exemplary embodiment of a driving method of the disclosure.

FIG. 5 is a schematic diagram of an exemplary embodiment of a driving method of the disclosure. The driving method can be applied to a display device. The display device comprises a plurality of sub-pixels. In this embodiment, the sub-pixels are arranged in an array. The amount of rows of the array is less than 500, but the disclosure is not limited thereto.

First, a first scan signal and a second scan signal are provided (step S510). In one embodiment, a gate driver is utilized to provide a first scan signal and a second scan signal. In some embodiments, the gate driver utilizes the DDS to generate a first scan signal and a second scan signal.

When the first scan signal is asserted, a first data signal is provided (step S520). The first scan signal and the first data signal can respond with a first response signal. In this embodiment, the first response signal is the voltage difference between the first scan signal and the first data signal. Furthermore, the first response signal comprises a selection stage and a non-selection stage, wherein the pulse number in the non-selection stage is equal to zero. In other embodiments, the first response signal does not comprise the non-selection stage.

When the second scan signal is asserted, a second data signal is provided (step S530). The second scan signal and the second data signal can respond with a second response signal. The amount of pulses of the first response signal is different from the amount of pulses of the second response signal. In this embodiment, the second response signal is the voltage difference between the second scan signal and the second data signal. In one embodiment, the second response signal comprises a selection stage and a non-selection stage, wherein the pulse number in the non-selection stage is equal to zero. In other embodiments, the second response signal does not comprise the non-selection stage.

The first response signal is provided to a first sub-pixel among a plurality of sub-pixels (step S540). In this embodiment, the first sub-pixel displays a first color. Additionally, when the amount of pulses of the first response signal is increased, the brightness of the first sub-pixel is brighter. When the amount of pulses of the first response signal is reduced, the brightness of the first sub-pixel is darker.

The second response signal is provided to a second sub-pixel among the sub-pixels (step S550). In this embodiment, the second sub-pixel displays a second color. The second color is different from the first color. Additionally, when the amount of pulses of the second response signal is increased, the brightness of the second sub-pixel is brighter. When the amount of pulses of the second response signal is reduced, the brightness of the second sub-pixel is darker.

In this embodiment, the amount of pulses of the response signals relates to the color displayed by the sub-pixel. For example, when the first color is a red color and the second color is a green color, the amount of pulses of the first response signal is more than the amount of pulses of the second response signal. When the first color is a blue color and the second color is a green color, the amount of pulses of the first response signal is less than the amount of pulses of the second response signal.

The amount of pulses of the response signal can be determined according to the reflectivity-voltage curves of the sub-pixels. For example, when a sub-pixel receives a preset voltage, the reflectivity of the sub-pixel can be measured. The reflectivity-voltage curve of the sub-pixel can be obtained according to the measured reflectivity and the preset voltage.

Accordingly, if the first sub-pixel receives a first preset voltage and the second sub-pixel receives a second preset voltage, the reflectivity of the first and the second sub-pixels can be obtained after measuring the first and the second sub-pixels. The reflectivity of the first sub-pixel is referred to as a first reflectivity. The reflectivity of the second sub-pixel is referred to as a second reflectivity. In this embodiment, when the first reflectivity is the same as the second reflectivity, the voltage difference between the first and the second preset voltages is less than 100V.

Figure 6:
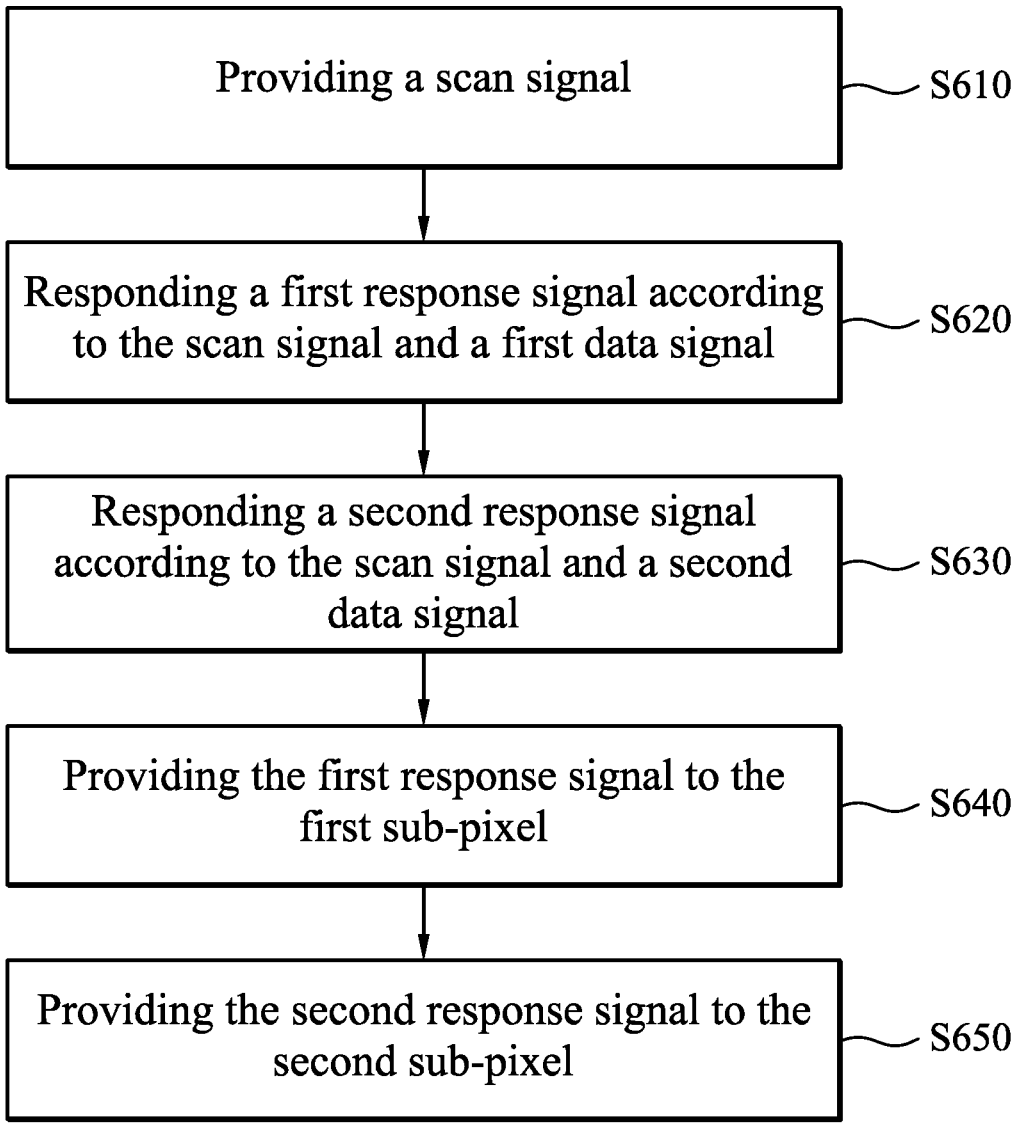
FIG. 6 is a schematic diagram of another exemplary embodiment of a driving method of the disclosure.

FIG. 6 is a schematic diagram of another exemplary embodiment of a driving method of the disclosure. When the gate driver 110 transmits the scan signal $S_{S1}$ to the different sub-pixels via the same scan line (e.g. $SL_1$), the driving method described in FIG. 6 can be employed. Furthermore, in this embodiment, the sub-pixels $P_{11}$~$P_{mn}$ do not overlap with each other (as shown in FIG. 3A). In one embodiment, the sub-pixels $P_{11}$~$P_{mn}$ are arranged in an array. The amount of rows of the array is less than 500, but the disclosure is not limited thereto. In some embodiments, a portion of the sub-pixels $P_{11}$~$P_{mn}$ are overlapping with each other (as shown in FIG. 3B).

First, a scan signal is provided (step S610). The scan signal and a first data signal respond to a first response signal (step S620). The scan signal and a second data signal responds to a second response signal (step S630). Taking FIG. 1 as an example, the scan signal $S_{S1}$ with the data signal $S_{D1}$ can respond to a response signal and the scan signal $S_{S1}$ with the data signal $S_{D2}$ can respond to another response signal.

The amount of pulses of the first response signal is different from the amount of pulses of the second response signal. Each of the first and the second response signals comprises a selection stage and a non-selection stage. In one embodiment, the amount of pulses of the non-selection stage is equal to zero (e.g. $S_{r11}$ shown in FIG. 4A).

In this embodiment, the first response signal is the voltage difference between the scan signal and the first data signal. Similarly, the second response signal is the voltage difference between the scan signal and the second data signal.

The first response signal is provided to a first sub-pixel (step S640). The second response signal is provided to a second sub-pixel (step S650). The first sub-pixel displays a first color according to the first response signal. The second sub-pixel displays a second color according to the second response signal. In this embodiment, the first color is different from the second color.

In one embodiment, the amount of pulses of the response signals relates to the brightness of the sub-pixel. For example, when the amount of pulses of the first response signal is increased, the brightness of the first sub-pixel is brighter. Contrarily, when the amount of pulses of the first response signal is reduced, the brightness of the first sub-pixel is darker.

In another embodiment, the amount of pulses of the response signals relates to the color displayed by the sub-pixel. For example, when the first sub-pixel displays a red color and the second sub-pixel displays a green color, the amount of pulses of the first response signal is more than the amount of pulses of the second response signal. In some embodiments, when the first sub-pixel displays a blue color and the second sub-pixel displays a green color, the amount of pulses of the first response signal is less than the amount of pulses of the second response signal.

In this embodiment, the pulse shape of the scan signal or the data signal is controlled according to the reflectivity-voltage curves of the sub-pixels. Thus, the amount of pulses of the response signal can be defined for color balance. The method for defining the reflectivity-voltage curves is described in FIG. 4B, thus description is omitted here for brevity.

While the disclosure has been described by way of example and in terms of the preferred embodiments, it is to be understood that the disclosure is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A display device, comprising:

a gate driver providing a first scan signal and a second scan signal and sequentially asserting the first and the second scan signals;

a data driver providing a first data signal and a second data signal, wherein when the first scan signal is asserted, the first scan signal and the first data signal respond with a first response signal, when the second scan signal is asserted, the second scan signal and the second data signal respond with a second response signal, and the pulse of the first response signal is different from the pulse of the second response signal; and a plurality of sub-pixels, wherein a first sub-pixel among the sub-pixels displays a first color according to the first response signal, a second sub-pixel among the sub-pixels displays a second color according to the second response signal, and the first color is different from the second color.

2. The display device as claimed in claim 1, wherein the gate driver provides the first and the second scan signals according to a dynamic driving scheme (DDS).

3. The display device as claimed in claim 1, wherein the first response signal is the voltage difference between the first scan signal and the first data signal.

4. The display device as claimed in claim 1, wherein the amount of pulses of the first response signal is different from the amount of pulses of the second response signal.

5. The display device as claimed in claim 4, wherein when the amount of pulses of the first response signal is increased, the brightness of the first sub-pixel becomes brighter and when the amount of pulses of the first response signal is reduced, the brightness of the first sub-pixel becomes darker.

6. The display device as claimed in claim 1, wherein the first response signal comprises a selection stage and a non-selection stage and the amount of pulses of the non-selection stage is equal to zero.

7. The display device as claimed in claim 1, wherein the amount of pulses of the first response signals relates to the first color and the amount of pulses of the second response signals relates to the second color.

8. The display device as claimed in claim 7, wherein when the first color is a red color and the second color is a green color, the amount of pulses of the first response signal is more than the amount of pulses of the second response signal.

9. The display device as claimed in claim 7, wherein when the first color is a blue color and the second color is a green color, the amount of pulses of the first response signal is less than the amount of pulses of the second response signal.

10. A display device comprising:

a gate driver providing a scan signal;

a data driver providing a first data signal and a second data signal, wherein the scan signal and the first data signal respond with a first response signal, the scan signal and the second data signal respond with a second response signal, and the pulse of the first response signal is different from the pulse of the second response signal; and a plurality of sub-pixels, wherein a first sub-pixel among the sub-pixels displays a first color according to the first response signal, a second sub-pixel among the sub-pixels displays a second color according to the second response signal, and the first color is different from the second color.

11. The display device as claimed in claim 10, wherein the first response signal is the voltage difference between the scan signal and the first data signal.

12. The display device as claimed in claim 10, wherein the amount of pulses of the first response signal is different from the amount of pulses of the second response signal.

13. The display device as claimed in claim 12, wherein when the amount of pulses of the first response signal is increased, the brightness of the first sub-pixel becomes brighter and when the amount of pulses of the first response signal is reduced, the brightness of the first sub-pixel becomes darker.

14. The display device as claimed in claim 10, wherein the first response signal comprises a selection stage and a non-selection stage and the amount of pulses of the non-selection stage is equal to zero.

15. The display device as claimed in claim 10, wherein the amount of pulses of the first response signal relates to the first color and the amount of pulses of the second response signal relates to the second color.

16. The display device as claimed in claim 15, wherein when the first color is a red color and the second color is a green color, the amount of pulses of the first response signal is more than the amount of pulses of the second response signal.

17. The display device as claimed in claim 15, wherein when the first color is a blue color and the second color is a green color, the amount of pulses of the first response signal is less than the amount of pulses of the second response signal.

18. The display device as claimed in claim 10, wherein the first sub-pixel does not overlap the second sub-pixel.

19. The display device as claimed in claim 10, wherein the first sub-pixel overlaps the second sub-pixel.

20. A driving method, comprising:

asserting a first scan signal and a second scan signal sequentially;

providing a first data signal when the first scan signal is asserted, wherein the first scan signal and the first data signal respond with a first response signal;

providing a second data signal when the second scan signal is asserted, wherein the second scan signal and the second data signal respond with a second response signal and the pulse of the first response signal is different from the pulse of the second response signal;

providing the first response signal to a first sub-pixel among a plurality of sub-pixels, wherein the first sub-pixel displays a first color; and providing the second response signal to a second sub-pixel among a plurality of sub-pixels, wherein the second sub-pixel displays a second color and the first color is different from the second color.

21. The driving method as claimed in claim 20, wherein a dynamic driving scheme (DDS) is utilized to provide the first and the second scan signals.

22. The driving method as claimed in claim 20, wherein the voltage difference between the first scan signal and the first data signals serves as the first response signal.

23. The driving method as claimed in claim 20, wherein the amount of pulses of the first response signal is different from the amount of pulses of the second response signal.

24. The driving method as claimed in claim 20, wherein when the amount of pulses of the first response signal is increased, the brightness of the first sub-pixel becomes brighter and when the amount of pulses of the first response signal is reduced, the brightness of the first sub-pixel becomes darker.

25. The driving method as claimed in claim 20, wherein the first response signal comprises a selection stage and a non-selection stage and the amount of pulses of the non-selection stage is equal to zero.

26. The driving method as claimed in claim 20, wherein the amount of pulses of the first response signals relates to the first color and the amount of pulses of the second response signals relates to the second color.

27. The driving method as claimed in claim 26, wherein when the first color is a red color and the second color is a green color, the amount of pulses of the first response signal is more than the amount of pulses of the second response signal.

28. The driving method as claimed in claim 26, wherein when the first color is a blue color and the second color is a green color, the amount of pulses of the first response signal is less than the amount of pulses of the second response signal.

29. A driving method, comprising:

providing a scan signal;

responding a first response signal according to the scan signal and a first data signal;

responding a second response signal according to the scan signal and a second data signal, wherein the pulse of the first response signal is different from the pulse of the second response signal;

providing the first response signal to a first sub-pixel among a plurality of sub-pixels, wherein the first sub-pixel displays a first color; and providing the second response signal to a second sub-pixel among a plurality of sub-pixels, wherein the second sub-pixel displays a second color and the first color is different from the second color.

30. The driving method as claimed in claim 29, wherein the voltage difference between the scan signal and the first data signals serves as the first response signal.

31. The driving method as claimed in claim 29, wherein the amount of pulses of the first response signal is different from the amount of pulses of the second response signal.

32. The driving method as claimed in claim 31, wherein when the amount of pulses of the first response signal is increased, the brightness of the first sub-pixel becomes brighter and when the amount of pulses of the first response signal is reduced, the brightness of the first sub-pixel becomes darker.

33. The driving method as claimed in claim 29, wherein the first response signal comprises a selection stage and a non-selection stage and the amount of pulses of the non-selection stage is equal to zero.

34. The driving method as claimed in claim 29, wherein the amount of pulses of the first response signals relates to the first color and the amount of pulses of the second response signals relates to the second color.

35. The driving method as claimed in claim 34, wherein when the first color is a red color and the second color is a green color, the amount of pulses of the first response signal is more than the amount of pulses of the second response signal.

36. The driving method as claimed in claim 34, wherein when the first color is a blue color and the second color is a green color, the amount of pulses of the first response signal is less than the amount of pulses of the second response signal.

* * * * *